US006105856A

United States Patent [19]

Kakiuchi

[11] Patent Number: 6,105,856

[45] **Date of Patent: *Aug. 22, 2000**

[54] HINGED-LID TYPE PACK

[75] Inventor: Sadao Kakiuchi, Tokyo, Japan

[73] Assignee: Japan Tobacco Inc., Tokyo, Japan

[ * ] Notice: This patent is subject to a terminal disclaimer.

[21] Appl. No.: 09/091,670

[22] PCT Filed: Oct. 24, 1997

[86] PCT No.: PCT/JP97/03871

§ 371 Date: Jun. 18, 1998

§ 102(e) Date: Jun. 18, 1998

[87] PCT Pub. No.: WO98/18683

PCT Pub. Date: May 7, 1998

[30] Foreign Application Priority Data

Oct. 25, 1996 [JP] Japan ..... 8-283849

[51] Int. Cl.[7] ..... B65D 43/16

[52] U.S. Cl. ..... 229/148; 206/268; 206/273; 229/160.1

[58] Field of Search ..... 229/146, 148, 229/160.1; 206/268, 273

[56] References Cited

U.S. PATENT DOCUMENTS

| | | | |
|---|---|---|---|
| 2,369,387 | 2/1945 | Williamson et al. | 206/268 |
| 2,839,236 | 6/1958 | Dunning | 229/148 |
| 3,684,159 | 8/1972 | Wolfe | 229/148 |
| 4,708,704 | 11/1987 | Focke et al. . | |
| 4,753,383 | 6/1988 | Focke et al. . | |
| 4,948,038 | 8/1990 | Moeller . | |
| 5,443,202 | 8/1995 | Jorgensen-Beck et al. | 229/146 |
| 5,518,172 | 5/1996 | Nanno | 229/148 |
| 5,586,648 | 12/1996 | Focke et al. . | |

FOREIGN PATENT DOCUMENTS

| | | |
|---|---|---|
| 2-296641 | 12/1990 | Japan . |
| B2 4-62937 | 10/1992 | Japan . |
| 8-53175 | 2/1996 | Japan . |
| 1119766 | 7/1968 | United Kingdom . |

*Primary Examiner*—Gary E. Elkins
*Attorney, Agent, or Firm*—Birch, Stewart, Kolasch & Birch, LLP

[57] ABSTRACT

A hinge lid pack for filter cigarettes comprises a body and lid. An Inner frame for forming a part of the body has a tongue, and an inner front flap of the lid has an engaging area, which is positioned close to an opening edge of the lid and engages with the tongue. The engaging area is formed by notching the inner front flap. When the lid is closed, the tongue is inserted between an inner surface of the lid and the engaging part. When the lid is opened and closed, the tongue clicks an edge of the engaging area so as to produce a clear click sound.

22 Claims, 5 Drawing Sheets

HINGED-LID TYPE PACK

This application is a national phase under 35 U.S.C. §371 of prior PCT International Application No. PCT/JP97/03871 which has an International filing date of Oct. 24, 1997 which designated the United States of America, the entire contents of which are hereby incorporated by reference.

The present invention relates to a hinge lid pack suitable for packaging cigarettes or filter cigarettes.

BACKGROUND ART

This kind of hinge lid pack is disclosed in, for example, Japanese Patent Application KOKAI Publication No.2-296641 (U.S. Pat. No. 4,948,038). This known pack comprises a box-shaped body whose upper end is opened. A box-shaped lid is connected to a rear opening edge of the body through a self-hinge. The lid rotates around the self-hinge so as to cover an opening end of the body or to be detached from the opening end. In other words, the lid opens and closes the opening of the body.

The body has a shoulder on its front surface, and the shoulder extends along a front opening edge of the body. The lid has a flap on its front opening edge, which is folded into the lid.

According to the above-explained hinge lid pack, when the opening end of the body is covered with the lid, the flap of the lid first comes in contact with the shoulder of the body, and then is further folded into the lid. When the opening end of the body is completely covered with the lid, the flap of the lid goes beyond the shoulder, and its tip edge butts against a lower edge of the shoulder. In this lid closing state, since the flap of the lid and the shoulder of the body are engaged with each other, there is no case where the lid is opened accidentally.

Just after the flap goes beyond the shoulder, the flap springs back and clicks the front surface of the body, so that a click sound occurs. Therefore, a user can confirm that the lid is completely closed by the click sound. In the case of the above-explained hinge lid pack, the lid overcomes the engagement between the flap and the shoulder so as to be opened. At this time, the flap is largely turned back. Even if the lid is opened and closed repeatedly only a few times, an elastic force of the flap root is abruptly lowered. Thereafter, even if the lid is closed, a spring force of the flap is poor, and the flap cannot produce a clear click sound.

Also, since the engagement between the flap and the shoulder becomes poor, the lid might be opened accidentally.

Moreover, if the elastic force of the flap is decreased, the flap cannot return to the lid and remains exposed at the outside of the lid even if the rid is opened. In this case, the user must fold the flap into the lid before the lid is closed.

SUMMARY OF THE INVENTION

An object of the present invention is to provide a hinge lid pack wherein a click sound can be surely produced even if the lid is opened and closed repeatedly and the lid can be stably maintained in a closing state.

The above object can be achieved by the following invention.

Specifically, the hinge lid pack comprises a body having a tongue and a lid having an engaging part engaging with the tongue. The tongue extends from the front surface of the body to the side opposite to the lid, and is rotatable around its root end. The engaging part is provided to have a gap on an inner surface of the lid. When the lid is closed, the tongue is inserted to the lid, thereby engaging with the engaging part.

According to the above-explained hinge lid pack, when the lid is opened with the rotation, the tongue and the engaging piece have engaged with each other, and the engagement provides resistance to the lid opening operation. For this reason, the lid is not opened accidentally.

When the lid overcomes resistance so as to be opened, the tongue of the body is detached from the gap of the lid. In other words, the engagement between the tongue and the engaging part is released. At this time, the tongue relatively clicks the engaging part so as to produce a click sound. Conversely, when the lid is closed, the engaging part is mounted on the tongue, so that the tongue is further folded. Thereafter, when the engaging part is detached from a tip of the tongue, the tongue relatively clicks the engaging part so as to produce the click sound.

A lid front wall includes an outer wall and an inner wall, which is overlaid on an inner surface of the outer wall. The inner wall has an engaging area for forming the engaging part. Favorably, the outer wall and the inner wall are integrally connected to each other. The inner wall is folded onto the inner surface of the outer wall, and the folding edges of these outer and inner walls form a lid front opening edge.

The inner wall is substantially overlaid on the entire inner surface of the outer wall, and has an opening for forming the engaging area at its central portion. More specifically, the opening of the inner wall is substantially a U-shaped notch. The notch is formed with leaving the engaging part close to the lid front opening edge. The notch of the lid easily provides the engaging part to the lid. Also, since the engaging area is close to the lid front opening edge, there is no case where the fold of the tongue is largely turned back by the engaging area when the lid is opened. As a result, the elastic force of a tongue root portion can be maintained for a long period of time. Then, the tongue can surely produce the click sound at the lid opening and closing time.

The inner wall is separated into a pair of inner wall portions by the notch. In this case, only these inner wall portions are bonded to the inner surface of the outer wall. Thereby, there can be easily obtained the gap for inserting the tongue between the inner surface of the lid and the engaging area.

Favorably, each inner wall portion has a width larger than the length of the engaging area, so that the engaging area can be stably maintained.

The tongue of the body can be provided in an inner frame for forming one end portion of the body. Specifically, the tongue integrally extends from substantially the U-shaped notch formed in the inner frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION

Figure 1:
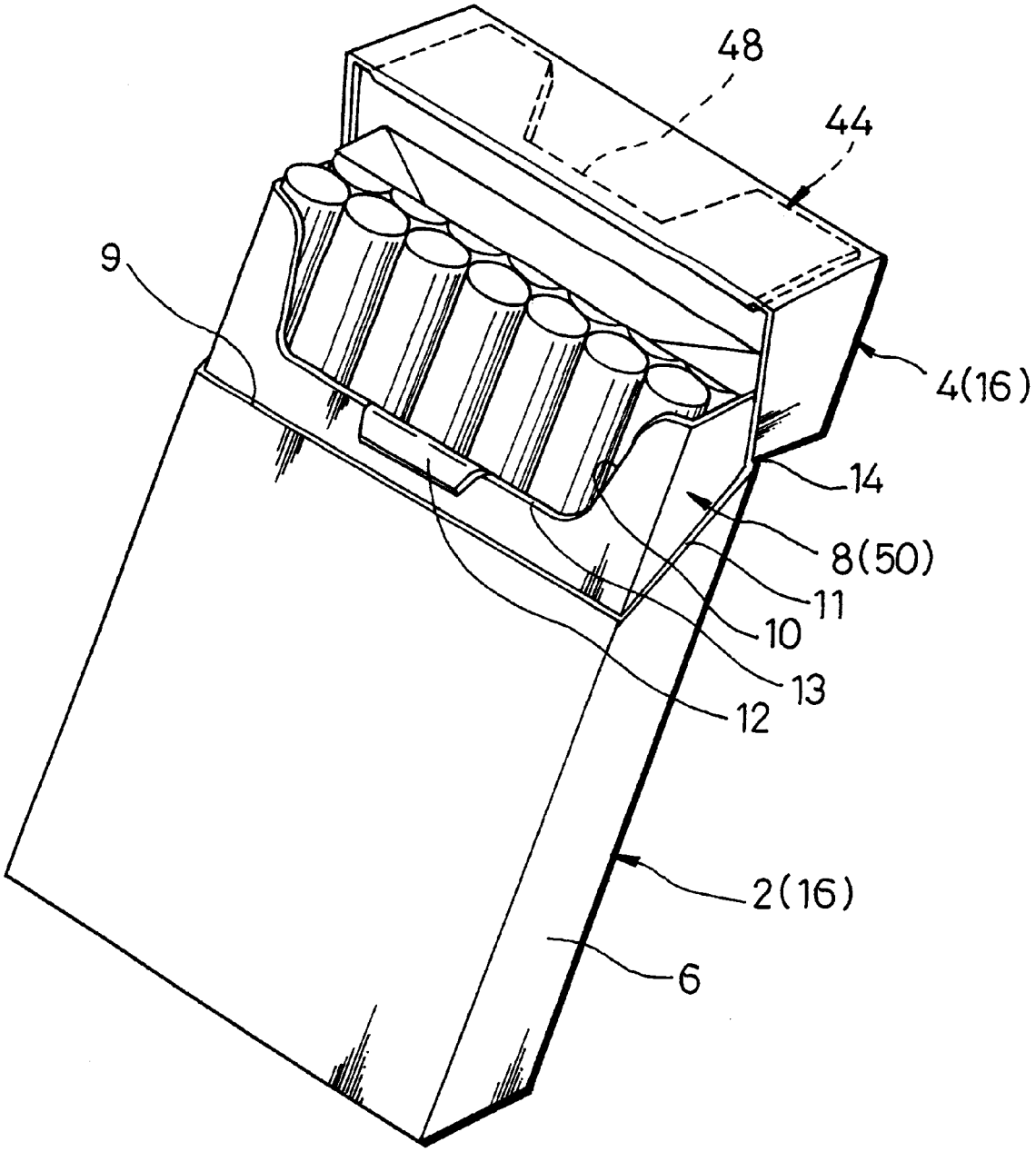
FIG. 1 is a perspective view showing a hinge lid pack for filter cigarettes.

Referring to FIG. 1, a hinge lid pack for filter cigarettes comprises a body 2 and a lid 4, and can contain 20 filter cigarettes.

The body 2 has a box-shaped outer frame 6 and an inner frame 8. The outer frame 6 has an opened upper end. More specifically, the opening of the outer frame 6 is inclined to its front surface side. The inner frame 8 has a U-shaped cross section, and is partially inserted to the opening of the outer frame 6. The inner frame 8 forms an upper end portion of the body 2, and is bonded to an inner surface of the outer frame 6. In other words, the inner frame 8 extends from a front opening edge 9 and right and left side opening edges 11 of the outer frame 6.

As is obvious from FIG. 1, the inner frame 8 has substantially a U-shaped notch 10 formed at the front surface of the frame 8. The notch 10 opens the front surface of the frame 8 widely, thereby making it easy to take up a filter cigarette from the body 2.

The notch 10 has a lower edge 13, which is parallel to the front opening edge 9 of the frame 6. The lower edge 13 is integral with a tongue 12. The tongue 12 is positioned at the center of the lower edge, and folded to the front surface of the inner frame 8.

The lid 4 is box-shaped, and is integrally connected to a rear opening edge of the frame 6 through a self-hinge 14. Therefore, the lid 4 can rotate around the self-hinge 14. If the lid 4 is rotated to the upper end portion of the body 2 from the state of FIG. 1, the lid 4 covers the upper end portion of the body 2, that is, inner frame 8, so that the pack is closed. In this case, the lid 4 closely contacts the front opening edge 9 and the side opening edges 11 of the outer frame 6. In other words, the lower end of the lid 4 is inclined to coincide with the opening end of the outer frame 6.

Figure 2:
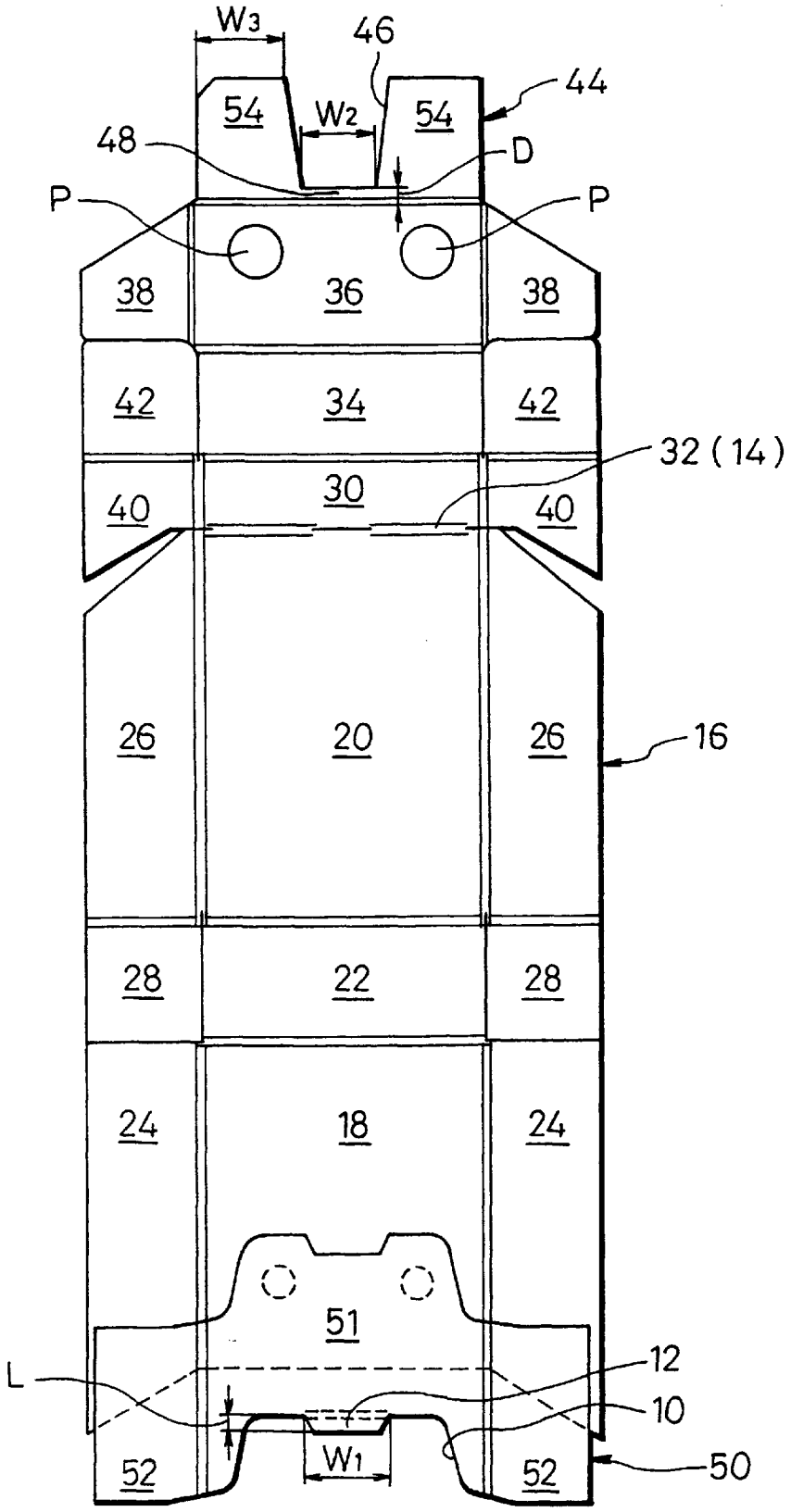
FIG. 2 is a view showing a blank for forming the pack of FIG. 1.

The outer frame 6 and lid 4 can be made of one blank. The blank is shown by FIG. 2. The blank 16 has numerous folding lines (double lines), which divide the blank 16 into a large number of sections. It is noted that FIG. 2 shows the inner surface of the blank 16.

As shown in FIG. 2, the blank 16 has a section 18 for forming a front wall of the frame 6 in its lower portion. A section 20 is connected to the upper side of the section 18 through a section 22. These sections are aligned on a longitudinal axis of the blank 16. The sections 20 and 22 are formed as a rear wall and a bottom wall of the frame 6, respectively.

The section 18 has outer side flaps 24, serving as right and left side walls of the frame 6, on its both sides, respectively. The section 20 has inner side flaps 26 on its both sides, respectively. These inner side flaps 26 serve as liners for the side walls, i.e., outer side flaps 24 when the outer frame 6 is formed.

As shown in FIG. 2, inner bottom flaps 28 are arranged between the inner side flaps 26 and the corresponding outer side flaps 24, respectively. These inner bottom flaps 28 are connected to the corresponding inner side flaps 26, respectively. The inner bottom flaps 28 are used as a liner for the bottom wall (section 22) when the outer frame 6 is formed.

On the opposite side to the section 22, sections 30, 34, and 36 are sequentially continued to the section 22. These sections 30, 34, and 36 are aligned on the longitudinal axis of the blank 16. The section 30 is formed as a rear wall of the lid 4. A boundary between the section 30 and the section 20 is formed as not a simple folding line but a hinge line 32 for the self-hinge 14. The sections 34 and 36 are formed as a top wall and a front wall of the lid 4, respectively.

Outer side flaps 38, serving as right and left side walls of the lid 4, are connected to both sides of the section 36, respectively. Inner side flaps 40 are connected to both sides of the section 30, respectively. These inner side flaps 40 serve as a liner for the side walls (outer side flaps 38) of the lid 4. As shown in FIG. 2, inner top flaps 42 are connected to the inner side flaps 40, respectively. These inner top flaps 42 are used as a liner for the top wall (section 34). Each inner top flap 42 is disposed between the outer and inner side flaps 38 and 40 on the corresponding side.

An inner front flap 44 is connected to an upper edge of the section 36. The inner front flap 44 is used as a liner for the front wall (section 36) of the lid 4. This means that the front wall of the lid 4 is made up of the section 36 as an outer wall and the inner front flap 44 as an inner wall.

As is obvious from FIG. 2, the inner front flap 44 has a notch 46 at the center of its tip edge. The notch 46 has an inverted trapezoid, i.e., substantially a U-shape, and extends to the section 36. The notch 46 separates the inner front flap 44 into right and left flaps 54. An engaging area 48 is reserved between the lower edge of the notch 46 and the section 36. The engaging area 48 has a predetermined length D in the direction of the longitudinal axis of the blank 16.

FIG. 2 also shows a blank 50 for the inner frame 8. The blank 50 is overlapped the inner surface of the section 18 of the blank 16, and bonded to each other. In FIG. 2, broken line circles denote areas where paste is applied to the section 18.

The blank 50 has a central section 51 and side flaps 52, which are connected to both sides of the section 51 through a folding line. The side flaps 52 serve as the side walls of the frame 8. The notch 10 and the tongue 12 are formed on the section 51, and the tongue 12 is connected to the section 51 through the folding line.

As is obvious from FIG. 2, the tongue 12 of the blank 50 and the engaging area 48 of the inner front flap 44 are positioned on the same line. The maximum width $W_1$ of the tongue 12 and the width $W_2$ of the engaging area 48 are the same as each other (for example, about 16 mm). Also, the length L of the tongue 12 and the depth D of the engaging area 48 are the same as each other (for example, about 3 mm).

Moreover, width $W_3$ of each flap 54 is sufficiently longer than the depth D of the engaging area 48.

The blanks 16 and 50 are made of paper material such as card paper, Manila paper, aluminum metallized paper.

The basic weight and thickness of the blanks 16 and 50 are set in the ranges of 180 to 270 g/m$^2$ and 0.2 to 0.5 mm, respectively.

The blanks 16 and 50 are folded at the folding lines according to a predetermined order, so that the body 2 and lid 4 are formed, respectively. In the folding process, 20 filter cigarettes are supplied to the blank 16. Upon completion of folding the blanks 16 and 50, the hinge lid pack containing the filter cigarettes are closed. Thus, the body 2 and lid 4 are formed in the state in which the hinge lid pack is closed.

The tongue 12 of the inner frame 8 is different from the case of the section and flaps in the folding direction. In FIG. 2, broken lines denote the folding line for the tongue 12.

At the time of folding the blanks 16 and 50, the respective outer side flaps 24 are bonded to the corresponding inner side flaps 26, respectively. Also, the respective outer side flaps 38 are bonded to the corresponding inner side flaps 40, respectively.

Figure 3:
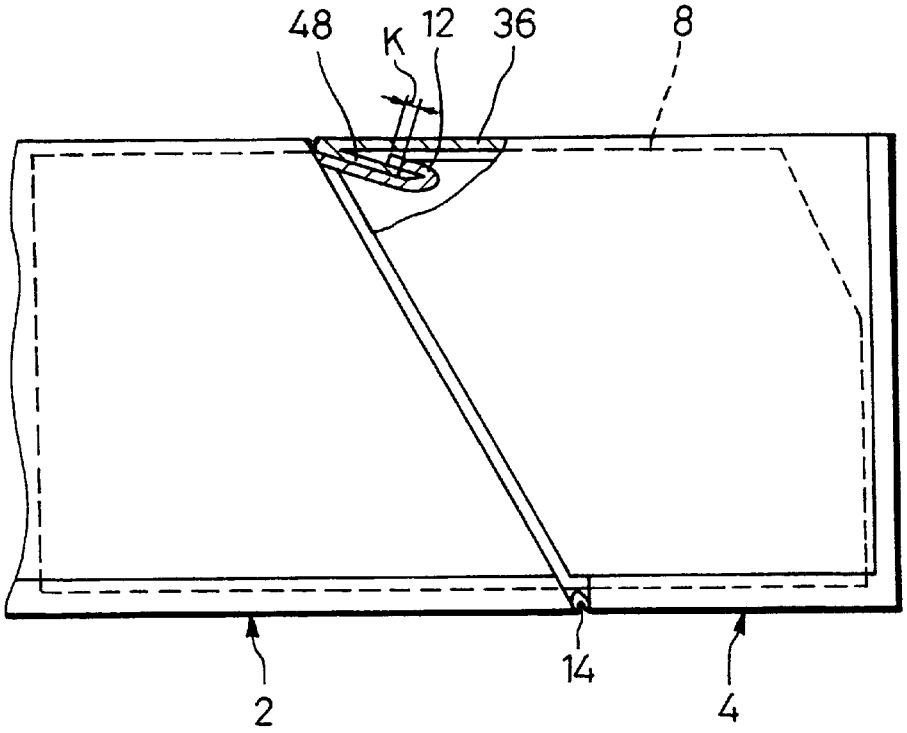
FIG. 3 is a view partly broken away to show a part of the pack of FIG. 1.

Moreover, the inner front flap 44 is folded onto the inner surface of the section 36 serving as the front wall of the lid 4, and bonded to the section 36. In FIG. 2, solid line circles P denote areas where paste is applied to the section 36. In the inner front flap 44, only the pair of separation flaps 54 are bonded to the section 36, and the engaging area 48 is not bonded thereto. More specifically, when the hinge lid pack is formed, the tongue 12 is allowed to insert between the engaging area 48 and the section 36, as shown in FIG. 3. As a result, the tongue 12 and the engaging area 48 are overlapped each other by a length K.

As is obvious from FIG. 3, when the formation of the pack is completed, the lid 4 covers the end portion on the opening side of the body 2, and the opening of the body 2 is closed. In this case, the opening edge of the outer frame 6 and that of the lid 4 are conformed to each other. The folding line between the section 36 and the inner front flap 44 forms the front portion of the lid opening edge.

Supposed that the tongue 12 is inserted between the inner surface (section 36) of the lid 4 and the engaging area 48 after the formation of the hinge lid pack. The engaging area 48 does not contact the inner surface of the lid 4 closely. Moreover, the portion of the engaging area 48 is deformed by the insertion of the tongue 12 so as to be raised above the inner surface of the lid 4.

The insertion of the tongue 12 partially increases the thickness of the opening edge portion of the lid 4. However, as is obvious from FIG. 3, the insertion elastically deforms the inner frame 8 to the pack partially. Consequently, the front surface of the body 2 and that of the lid 4 are positioned flush with each other.

Figure 4:
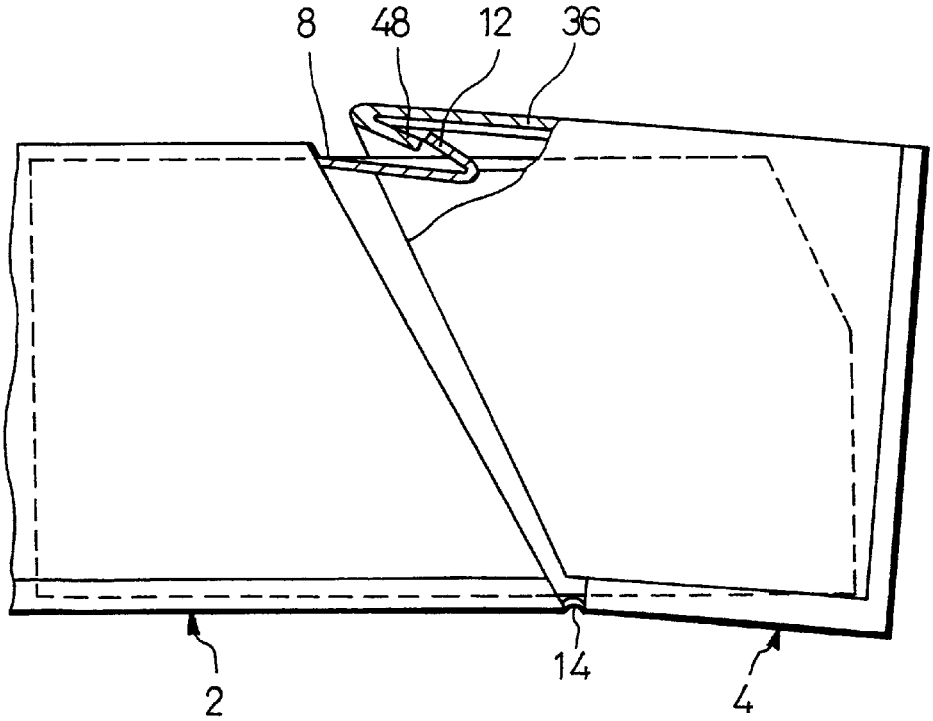
FIG. 4 is a view showing a state in which a lid starts to be opened from the state of FIG. 3.

As shown in FIG. 4, when the lid 4 is rotated around the self-hinge 14 from the closed state, that is, the lid 4 starts to be opened, the engaging area 48 lifts the tongue 12 with accompanying return of the tongue fold. The engagement between the engaging area 48 and the tongue 12 provides a predetermined resistance to the opening operation of the lid 4. As a result, there is no case where the lid 4 is opened accidentally.

Figure 5:
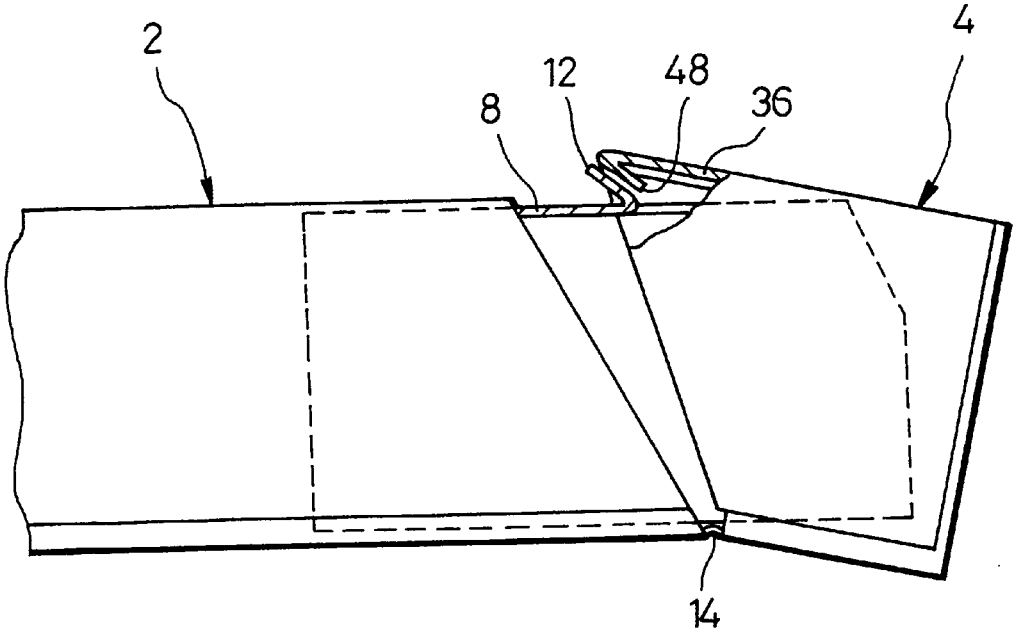
FIG. 5 is a view showing a state in which the engagement between a tongue and the lid is released from the state of FIG. 4.
Figure 6:
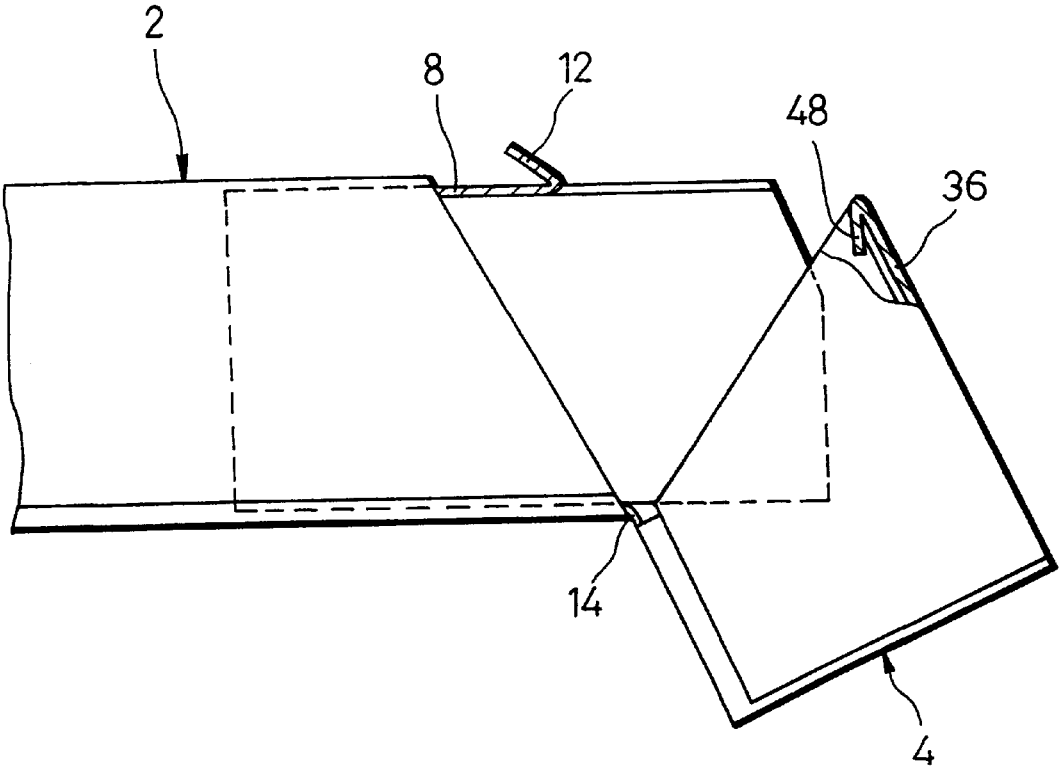
FIG. 6 is a view showing a state in which the lid is completely opened.

The lid 4 overcomes resistance so as to be further rotated, and the engagement between the engaging area 48 and the tongue 12 is released as shown in FIG. 5. At this time, the tip of the tongue 12 clicks the edge of the engaging area 48 so as to produce a click sound. The click sound serves as a signal showing the disengagement between the engaging area 48 and the tongue 12. It is noted that the partial elastic-deformation of the inner frame 8 is released when the lid 4 is in a state as shown in FIG. 5.

Thereafter, the lid 4 can be easily rotated to a full opening position from the state of FIG. 5 without receiving the above-mentioned resistance.

Figure 7:
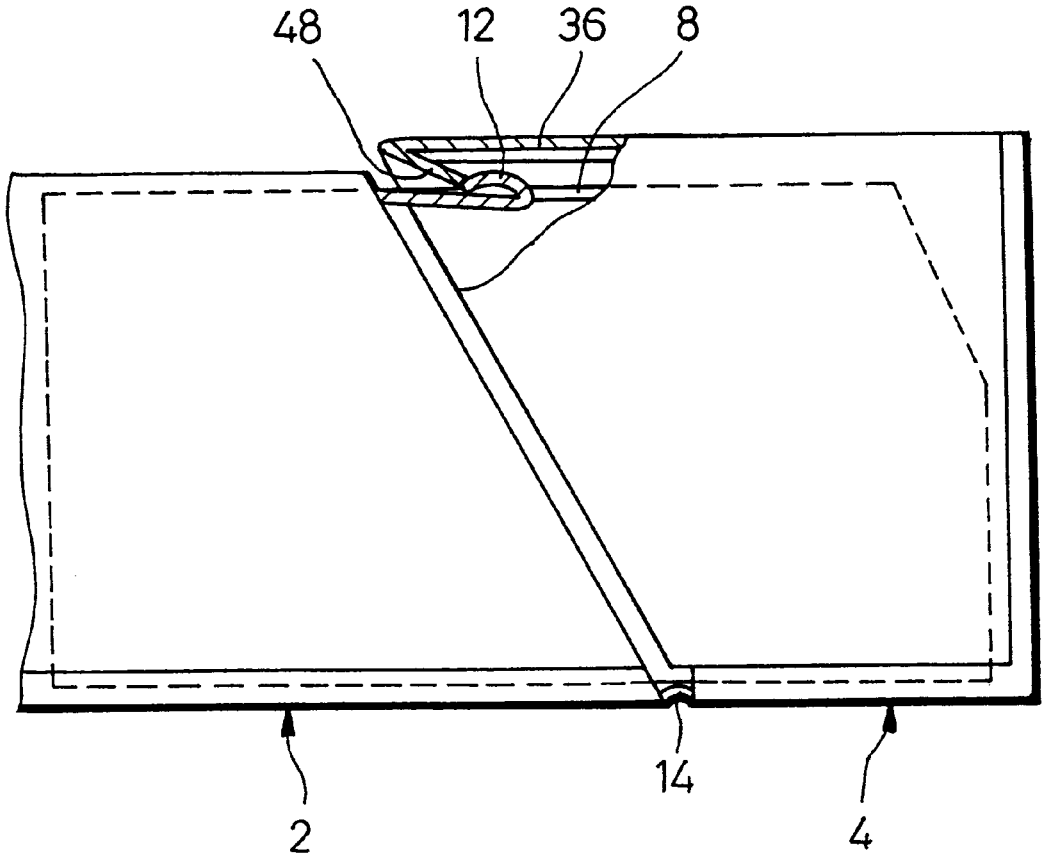
FIG. 7 is a view showing a state just before the lid is completely closed.

On the other hand, when the lid 4 is rotated in the reverse direction, that is, the lid closing direction, the engaging area 48 of the lid 4 mounts on the tongue 12 as shown in FIG. 7. This mounting presses the tongue 12 down. At the same time, the inner frame 8 is elastically deformed partially, again.

Thereafter, the lid 4 is further rotated and the mounting of the engaging area 48 on the tongue 12 is released. In this case, the tip of the tongue 12 also clicks the edge of the engaging area 48 so as to produce the click sound. The produced click sound serves as a signal showing a state of lid 4 just before being completely closed.

After the tongue 12 clicks the engaging area 48, the tongue 12 is returned to the original position. In this case, the reverse rotation of the lid 4 inserts the tip of the tongue 12 into the gap between the inner surface of the lid 4 and the engaging area 48 again. As a result, the lid 4 is set in the closed state as shown in FIG. 3.

In detecting the click sound, which was produced at the lid opening and closing time, at the position 30 cm away from the pack, the click sound was relatively clear with intensity of 13 to 20 dB.

The tongue 12 and the engaging area 48 are formed close to the opening edges of the body 2 and the lid 4, respectively. Therefore, the fold of the tongue 12 is not largely turned back by the engaging area 48 when the lid 4 is opened, so that elasticity of the tongue root portion can be maintained for a long period time. Consequently, even if the lid 4 is repeatedly opened and closed, the clear click sound surely occurs at the lid opening and closing time.

Since the tongue 12 and the engaging area 48 are formed integrally with the inner frame 8 and the lid 4, respectively, the structure of the body 2 and the lid 4 does not become complicated.

The inner front flap 44 of the lid is formed such that only separated flaps 54 are bonded onto the front wall (section 36) of the lid 4. Also, the widths $W_3$ of the separated flaps 54 are sufficiently longer than the depth D of the engaging area 48. Thus, since the inner flap 44 is firmly bonded onto the inner surface of the lid 4, rigidity of the engaging area 48 can be maintained even if the lid 4 is repeatedly opened and closed. As a result, the lid 4 is surely locked, and the click sound can be produced for a long period of time.

The present invention is not limited to the above-explained embodiment. For example, the outer frame 6 and inner frame 8 may be integrally formed. The inner frame 8 may have a lid lock on its right and left side walls. Moreover, the hinge lid pack of this invention can be applied to not only filter cigarettes but also various kinds of goods.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A hinge lid pack comprising:

a body having an opening end;

a lid connected to a rear opening edge of said body, the lid closing the opening end when covering the opening end of said body;

a tongue connected to a front surface of said body, the front surface of the body being opposed to a rear surface of the body, the rear opening edge being on the rear surface of the body, the tongue being pivotable around a root portion thereof; and an engaging part formed on an inner surface of a front wall of said lid, a gap being formed by the engaging part and said tongue being insertable into the gap when said lid is closed, wherein the front wall of said lid includes an outer wall and an inner wall, and said inner wall is overlaid on an inner surface of the outer wall, and has an engaging area forming said engaging part, said outer and inner walls are integrally connected to each other, said inner wall being folded onto said outer wall, and said inner wall has an opening forming said engaging area at a central portion thereof.

2. The hinge lid pack according to claim 1, wherein said lid abuts the body at an edge of the outer wall when the lid is closed, said opening of said inner wall being substantially a U-shaped notch extending towards the edge of said outer wall from a tip of said inner wall, and said notch is formed such that said engaging area is close to a front opening edge of said lid.

3. The hinge lid pack according to claim 2, wherein said notch of said inner wall separates said inner wall into a pair of inner wall portions, and only said inner wall portions are bonded to the inner surface of said outer wall.

4. The hinge lid pack according to claim 2, wherein said notch of said inner wall separates said inner wall into a pair of inner wall portions, and each inner wall portion has a width larger than a length of said engaging area defined between the front opening edge of said lid and said notch.

5. The hinge lid pack according to claim 2, wherein said body includes an outer body and an inner frame, and said inner frame is connected to said outer body to form the opening end of said body.

6. The hinge lid pack according to claim 5, wherein said inner frame has substantially a U-shaped notch on a front opening edge of the inner frame, and said tongue extends from an edge of said notch of the inner frame.

7. The hinge lid pack according to claim 1, wherein said lid and said body are substantially parallelepipedal.

8. A hinge lid pack comprising:

a body having an opening end;

a lid connected to a rear opening edge of said body and closing the opening end when covering the opening end of said body, said lid including a front wall which includes an outer wall and an inner wall;

a tongue connected to a front surface of the opening end of said body, the tongue being pivotable around a tongue root portion; and an engaging part formed on an inner surface of said front wall of said lid and forming a gap, a tip of said tongue being insertable into the gap;

said inner and outer walls being integrally formed, with said inner wall folded onto said outer wall so that the inner wall overlays an inner surface of the outer wall; and said inner wall including an engaging area forming said engaging part, said engaging area being located at a central portion of an opening in the inner wall.

9. The hinge lid pack according to claim 8, wherein the lid abuts the body at an edge of the outer wall when the lid is closed, said opening of said inner wall being substantially a U-shaped notch extending towards the edge of said outer wall from a tip of said inner wall, and said notch is formed such that said engaging area is close to a front opening edge of said lid.

10. The hinge lid pack according to claim 8, wherein said body includes an outer body and an inner frame, said inner frame being connected to said outer body and forming the opening end of said body.

11. The hinge lid pack according to claim 8, wherein said lid and said body are substantially parallelepipedal.

12. A hinge lid pack comprising:

a body having an opening end;

a lid connected to a rear opening edge of said body and closing the opening end of the body, wherein a front opening edge of the lid is proximate to a front opening edge of the body when the lid is closed;

a tongue connected to the body, a gap being formed between the tongue and the body; and an engaging area formed on the lid, the engaging area being insertable into the gap when the lid is closed.

13. The hinge lid pack according to claim 12, wherein the tongue projects substantially downwardly from a tongue root portion towards a base portion of the body.

14. The hinge lid pack according to claim 12, wherein the body includes an outer body and an inner frame.

15. The hinge lid pack according to claim 14, wherein the tongue projects substantially downwardly from a tongue root portion towards a base portion of the body.

16. The hinge lid pack according to claim 14, wherein the tongue is an extension of the inner frame.

17. The hinge lid pack according to claim 16, wherein the inner frame forms a portion of the opening end of the body, and includes a notch section, said tongue extending from a central portion of the notch section.

18. The hinge lid pack according to claim 17, wherein the gap formed between the body and the tongue is located between the notch section of the inner frame and the tongue.

19. The hinge lid pack according to claim 14, wherein the lid includes a front wall, the front wall including an inner wall and an outer wall, the inner wall being folded onto an inner surface of the outer wall.

20. The hinge lid pack according to claim 19, wherein the inner wall is divided into two inner front flaps, the flaps being separated by a notch in the inner wall.

21. The hinge lid pack according to claim 20, wherein the engaging area is located at a central portion of the notch in the inner wall.

22. The hinge lid pack according to claim 12, wherein said lid and said body are substantially parallelepipedal.

* * * * *